US006463640B1

(12) United States Patent
Toth

(10) Patent No.: US 6,463,640 B1
(45) Date of Patent: Oct. 15, 2002

(54) STRAP CONNECTING BUCKLE

(76) Inventor: Douglas J. Toth, 8422 Dallas Cir., Huntington Beach, CA (US) 92646

( * ) Notice: Subject to any disclaimer, the term of this patent is extended or adjusted under 35 U.S.C. 154(b) by 0 days.

(21) Appl. No.: 09/483,145

(22) Filed: Jan. 13, 2000

(51) Int. Cl.[7] ..... A44B 11/26
(52) U.S. Cl. ..... 24/648; 24/650; 24/702
(58) Field of Search ..... 441/64; 351/43, 351/44; 2/428, 452, 426, 450; 24/634, 635, 322.1–324, 669, 702, 598.5, 647, 648, 350

(56) References Cited

U.S. PATENT DOCUMENTS

| | | | | | |
|---|---|---|---|---|---|
| 402,880 | A | * | 5/1889 | Adler | 24/648 |
| 615,474 | A | * | 12/1898 | Brauch | 2/236 |
| 1,178,135 | A | * | 4/1916 | Cowell | 24/645 |
| 3,294,444 | A | * | 12/1966 | Anderson | 24/598.5 |
| 4,795,385 | A | * | 1/1989 | Matsuoka | 441/64 |
| 5,545,067 | A | * | 8/1996 | Garofalo | 441/64 |
| 5,561,891 | A | * | 10/1996 | Hsieh | 24/170 |
| 6,185,794 | B1 | * | 2/2001 | Maggi | 24/170 |
| 6,237,201 | B1 | * | 5/2001 | Bonaiti | 24/598.5 |

* cited by examiner

*Primary Examiner*—James R. Brittain
(74) *Attorney, Agent, or Firm*—Leonard Tachner

(57) ABSTRACT

A one-hand operated strap buckle capable of withstanding high forces and yet simple to operate and easily connected to a post and disconnected from a post. In a preferred embodiment, the buckle comprises upper and lower cases, the latter forming a slot for receiving a post with a flat head. When connected to a post, the buckle is secured to the post by a pair of swing arms terminating at locking hooks. The position of the swing arms is normally closed, but may be readily altered to an open position by a pair of opposed spring-loaded release tabs which when compressed toward one another, open the swing arms and separate the locking hooks. The buckle of the invention also comprises a strap release which is spring-loaded and normally engages the teeth of a strap by employing a spring-loaded catch which can be rotated away from the strap with tilting of the strap release around a fulcrum bearing. The locking hooks of the preferred embodiment, when in their locked position, assure a secure connection to the post which connection can withstand very high forces. Yet the locking hooks are easily separated when it is desired to release the strap from the post by simply squeezing the release tabs towards one another.

9 Claims, 6 Drawing Sheets

STRAP CONNECTING BUCKLE

BACKGROUND OF THE INVENTION

1. Field of the Invention

The present invention relates generally to the field of releasible buckles such as those used for securing a strap to a post on a piece of sporting equipment. The invention pertains more specifically to a highly secure locking buckle especially suited to applications requiring resistance to severe forces and yet quick and easy release when release is desired.

2. Background Art

Quick release buckles have become prolific in sports equipment. There are a large number of applications in golf equipment and diving equipment for example where quick release, strap locking buckles are used advantageously for securing various kinds of equipment. Such equipment includes for example, golf bags and buoyancy jackets both of which have buckled straps for carrying or securing equipment. Buckles for such applications have to be capable of resisting a modest amount of force and yet be easily released to permit quick unbuckling. Moreover, in some applications, the buckle must be both lockable and releasible with only one hand. One such one-hand application is the swim fin strap. Furthermore, a swim fin strap is subject to especially high forces due to the nature of the use of swim fins, namely, being forced up and down in water to propel a diver or snorkeler. In order to facilitate one-hand operation, a swim fin buckle strap will have a buckle at each end for attachment to a fixed post or pin which is affixed on each side of the fin. The buckle for attachment to such posts or pins, must be easy to attach, capable of withstanding constant tension and very high and frequent peak forces which would readily force open conventional strap buckles.

It would thus be highly advantageous to have a strap connecting buckle capable of one-hand operation for connection to a post or pin and designed for withstanding extreme forces of tension while still being easy to connect and to disconnect.

SUMMARY OF THE INVENTION

The present invention comprises a one-hand operated strap buckle capable of withstanding high forces and yet simple to operate and easily connected to a post and disconnected from a post. In a preferred embodiment, the buckle comprises upper and lower cases, the latter forming a slot for receiving a post with a flat head. When connected to a post, the buckle is secured to the post by a pair of swing arms terminating at locking hooks. The position of the swing arms is normally closed, but may be readily altered to an open position by a pair of opposed spring-loaded release tabs which when compressed toward one another, open the swing arms and separate the locking hooks. The buckle of the invention also comprises a strap release which is spring-loaded and normally engages the teeth of a strap by employing a spring-loaded catch which can be rotated away from the strap with tilting of the strap release around a fulcrum bearing. The locking hooks of the preferred embodiment, when in their locked position, assure a secure connection to the post which connection can withstand very high forces. Yet the locking hooks are easily separated when it is desired to release the strap from the post by simply squeezing the release tabs towards one another.

OBJECTS OF THE INVENTION

It is therefore a principal object of the present invention to provide a strap connecting buckle especially suited for quick connection to and release from a fixed post for one-hand operation.

It is another object of the invention to provide a quick release strap buckle which can withstand high tensile stress without inadvertent release.

It is yet another object of the invention to provide a strap buckle suitable for one-hand operation for connection to and release from a stationary post by simple compression of a pair of opposed release tabs.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
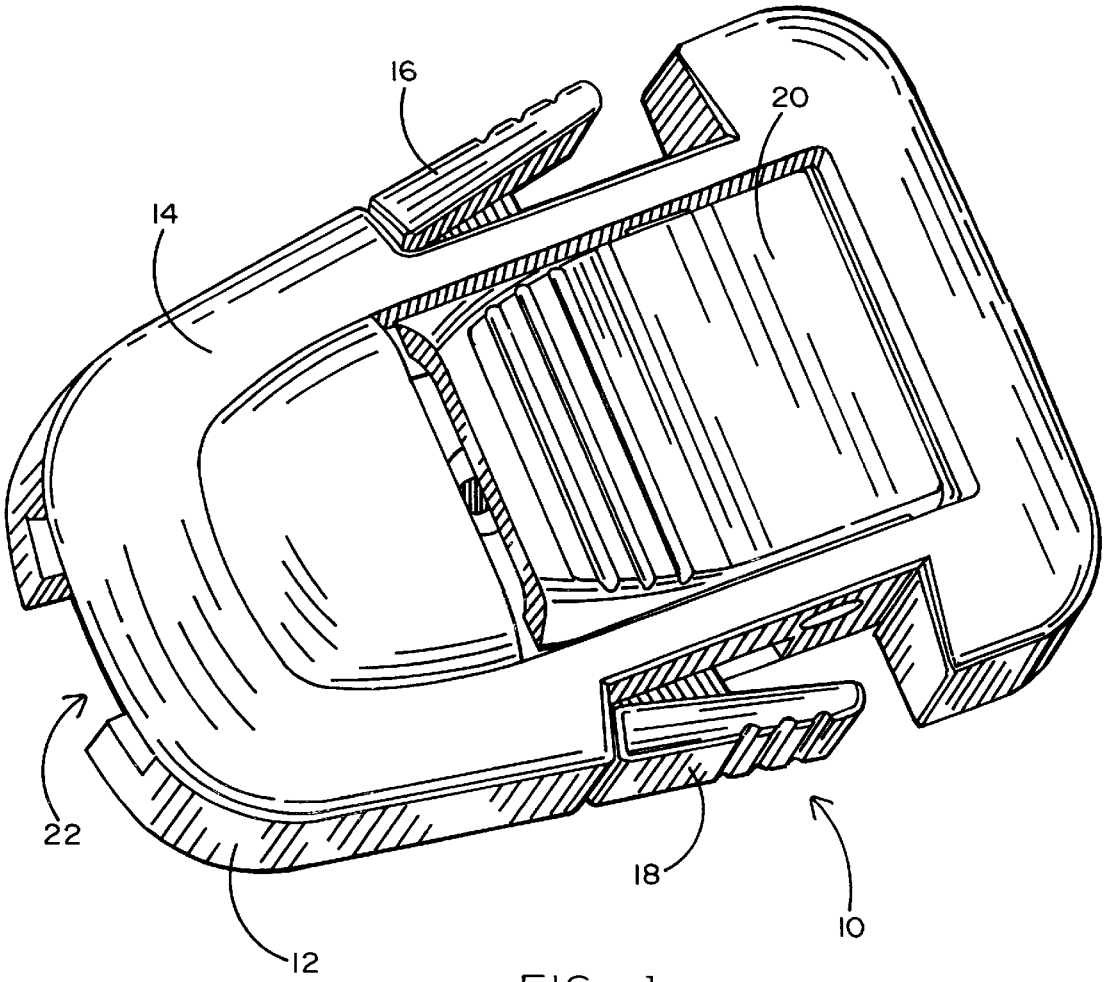
FIG. 1 is a three-dimensional drawing showing a preferred embodiment of the invention in its fully assembled configuration.
Figure 2:
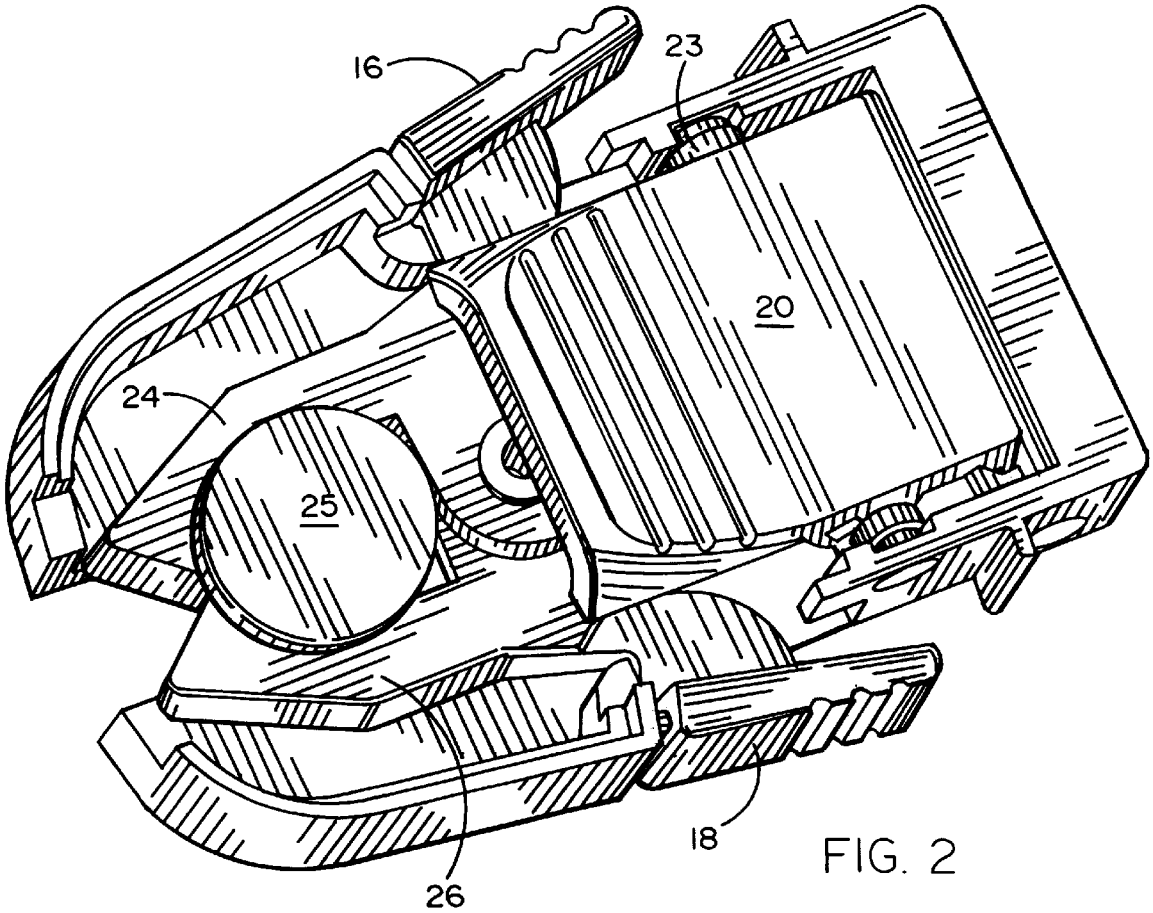
FIG. 2 is a drawing similar to FIG. 1, but with the upper case removed to reveal a post to which the buckle is connected.
Figure 10:
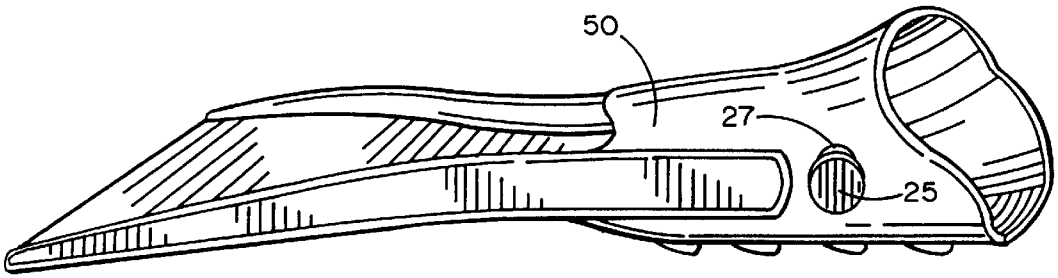
FIG. 10 is a view of a swim fin illustrating the position of one or more posts for receiving a corresponding number of buckles of the invention.

Referring to the accompanying drawings it will be seen that in accordance with a preferred embodiment of the invention, a strap locking buckle assembly 10 comprises a lower case 12 and an upper case 14. Buckle assembly 10 is normally closed but is easily opened by mutual compression of release tabs 16 and 18. A strap release 20 permits adjustment of the buckle assembly 10 relative to a strap which will become evident hereinafter. As seen in FIG. 1, buckle assembly 10 has a slotted opening 22 to receive a stationary post 27 of a swim fin 50 (see FIG. 10) to which connection is to be made.

Figure 3:
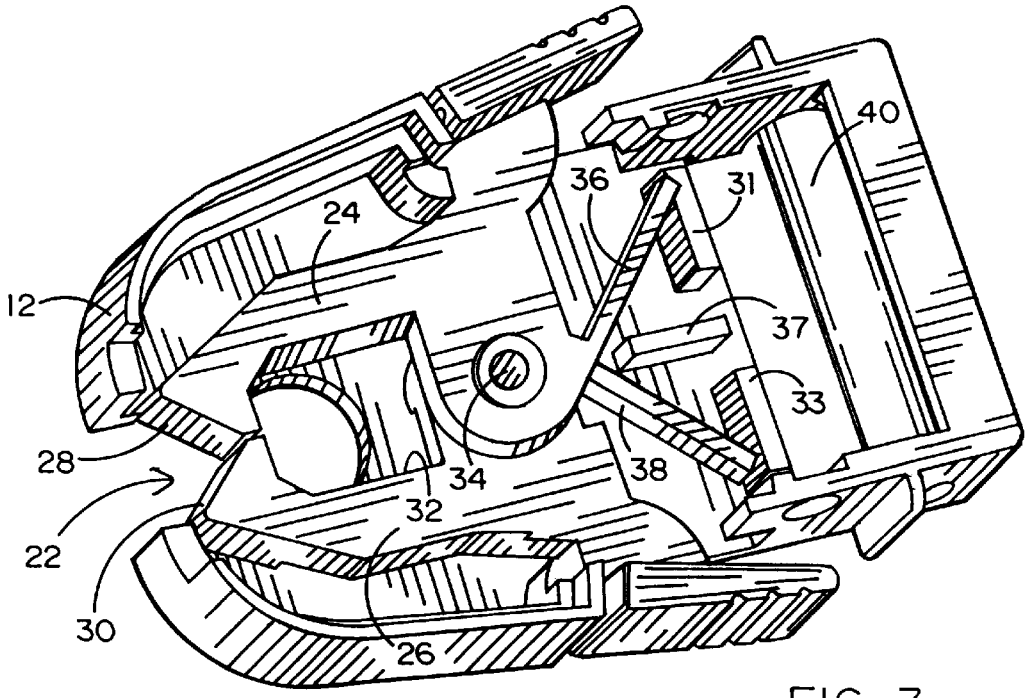
FIG. 3 is a drawing similar to FIG. 2 but with the strap release removed and the post removed.
Figure 4:
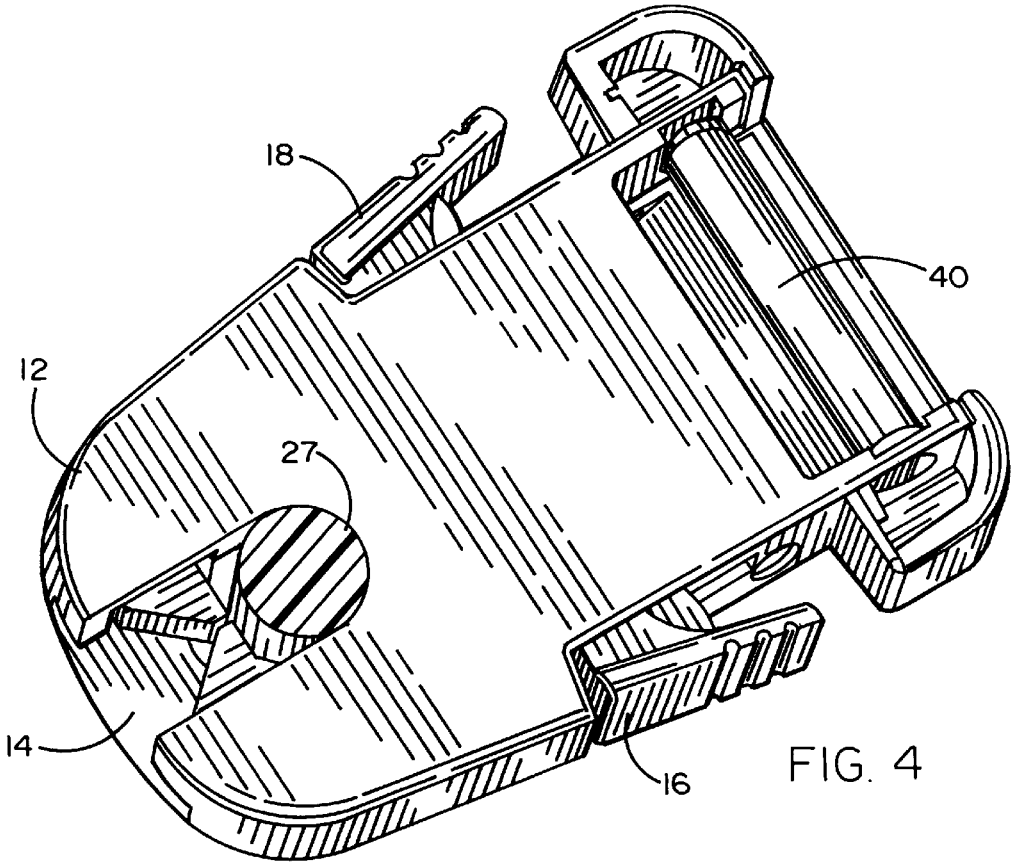
FIG. 4 is a three-dimensional drawing showing the bottom of the buckle with an attached post.
Figure 5:
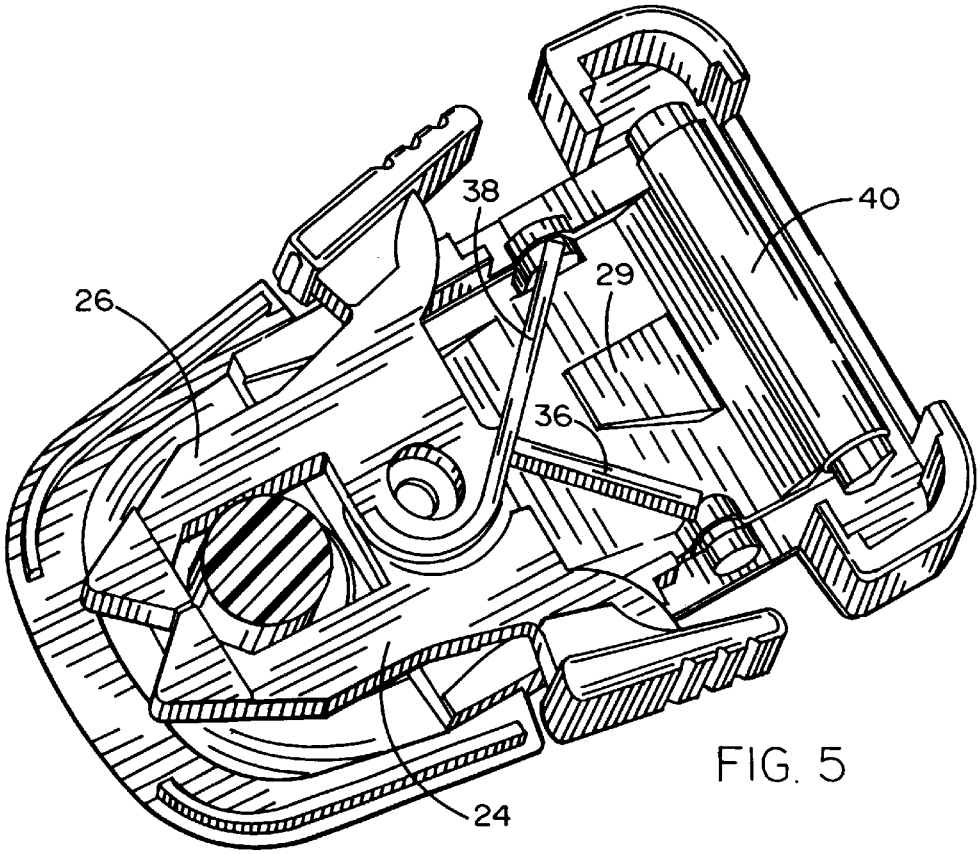
FIG. 5 is a drawing similar to FIG. 4, but with the lower case removed.
Figure 6:
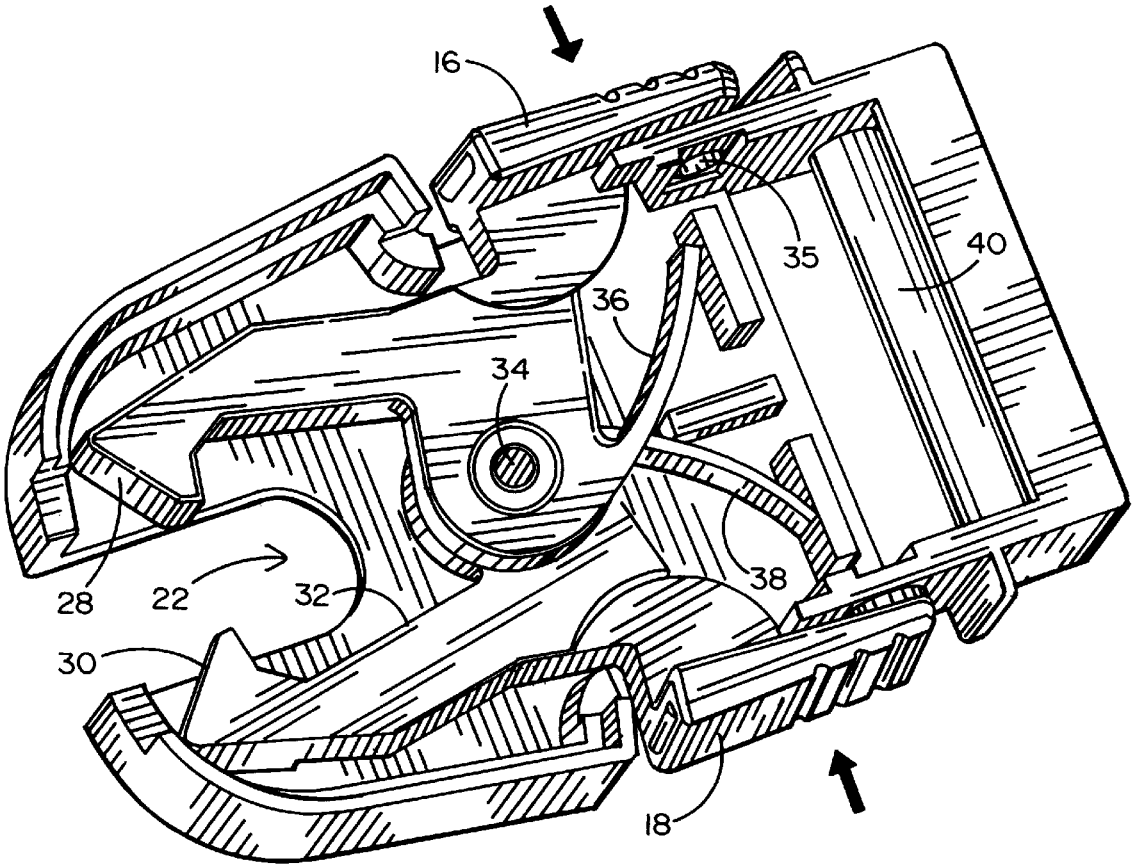
FIG. 6 is a view similar to FIG. 3, but showing the buckle in the opened position.

As seen best in FIGS. 2–7, buckle assembly 10 also comprises swing arms 24 and 26 which terminate in respective locking hooks 28 and 30. The swing arms are shaped to provide a generally rectangular post locking aperture 32 for receiving and retaining a post 27 having an enlarged head 25. The locked configuration is shown in FIG. 3 and the unlocked or release configuration is shown in FIG. 6. It will be noted that in the locked configuration of FIG. 3, release tabs 16 and 18 are farthest apart. In the release configuration of FIG. 6, release tabs 16 and 18 have been compressed towards one another and are at their closest positions. Locking hooks 28 and 30 are spring-loaded by means of arm springs 36 and 38 which are integrally formed with and extend from spring arms 24 and 26, respectively. A pair of spring stops 31 and 33 load the arm springs 36 and 38 causing the swing arms 24 and 26 to automatically return to the locked configuration of FIG. 3 when release tabs 16 and 18 are no longer compressed toward each other. Swing arms 24 and 26 both move angularly about a fulcrum 34 which may be in the form of a rivet or other fastener seen best in FIG. 7. As seen best in FIG. 2, when the buckle assembly 10 engages and locks a post 27, the head 25 of the post resides just above the swing arms with the shaft of the post firmly locked into the locking aperture 32. The enlarged post head prevents upward release of the buckle assembly 10. As long as locking hooks 28 and 30 are in their locked configuration seen in FIGS. 2 and 3, the buckle can resist very large pulling forces without releasing the post. However, by a simple compression of release tabs 16 and 18, locking hooks 28 and 30 separate and allow the buckle assembly 10 to be removed from post 27.

Figure 7:
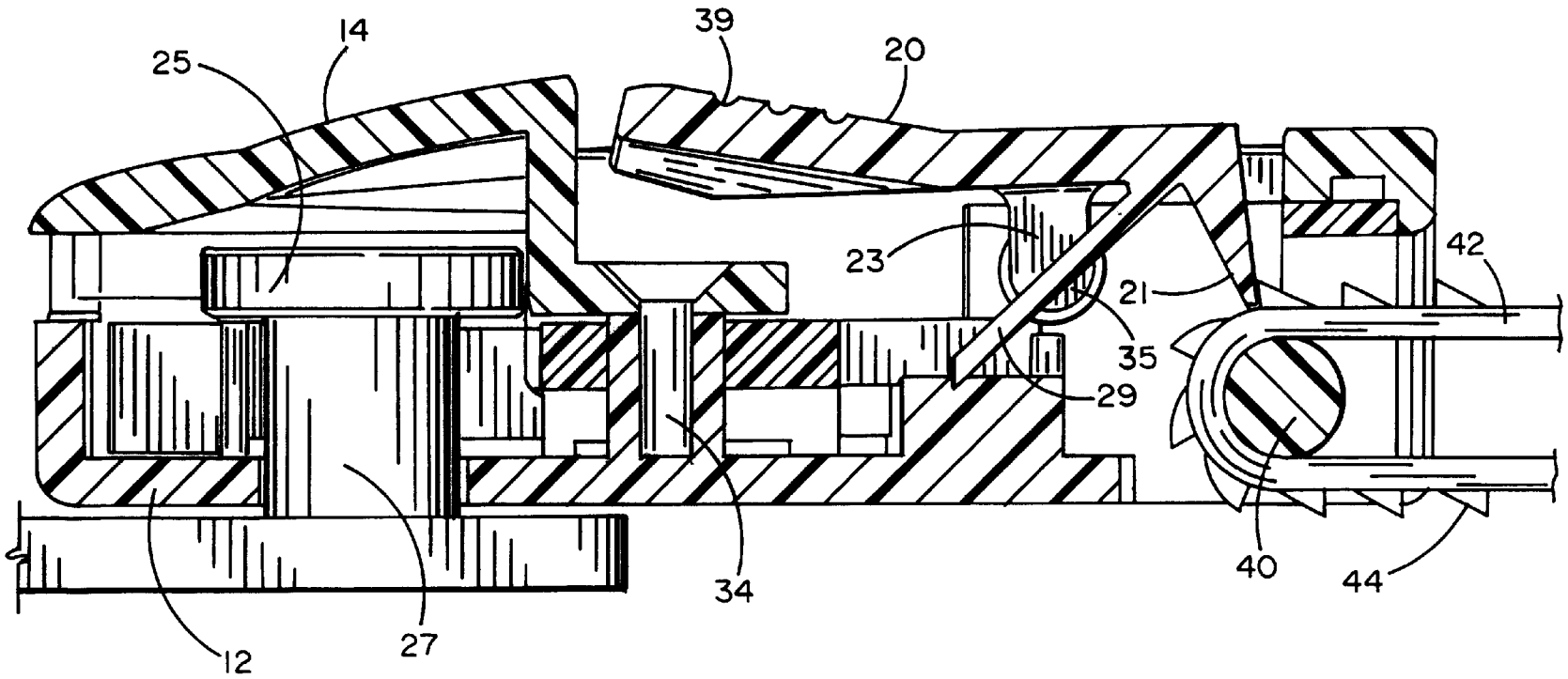
FIG. 7 is a cross-sectional side view of a fully assembled buckle shown connected to a post.

The operation of strap release 20 will be apparent from FIGS. 3, 5 and 7. As seen in those figures, strap release 20 is mounted for a rocking motion about a pair of bearings 23, each positioned in a bearing recess 35. A release spring arm 29 extends diagonally and downwardly and contacts a spring stop 37. The upper surface of strap release 20 has a knurled or scored portion 39 which facilitates frictional engagement to rotate stop release 20 about the bearings 23 and against the spring resistance caused by release spring 29 engaging spring stop 37.

Figure 8:
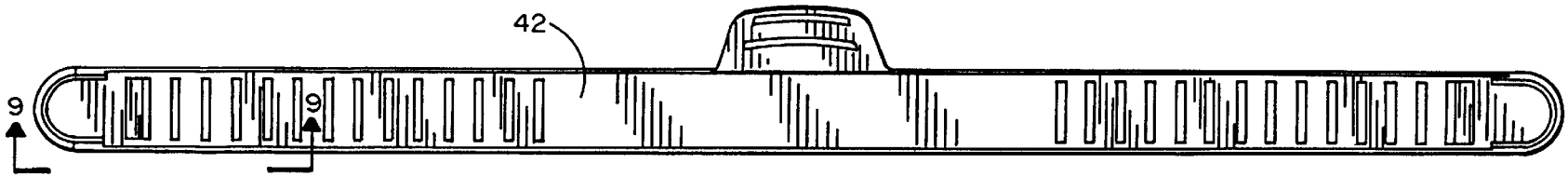
FIG. 8 is an elevational view of a strap that may be used with the buckle of the invention.
Figure 9:
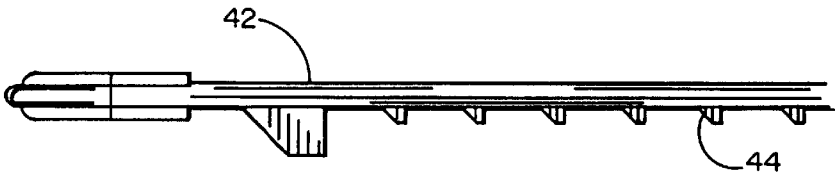
FIG. 9 is a side partial view of the strap of FIG. 8.

The buckle assembly 10 receives a strap 42 shown in FIGS. 8 and 9. As seen in FIG. 7, the strap 42 is wrapped around a strap roller 40. A plurality of spaced teeth 44 are mounted on the strap. The strap release 20 has a catch 21 extending toward the roller 40 and engaging teeth 44. When strap release 20 is rotated toward fulcrum 34, the catch is raised to permit strap 42 to be adjusted around roller 40.

Having thus disclosed a preferred embodiment of the invention, it being understood that modifications and additions to the disclosed embodiment are contemplated and that the described details are merely illustrative of the invention.

What is claimed is:

1. A buckle assembly for securing a strap to a fixed post having an enlarged head; the assembly comprising:

a pair of spring-loaded swing arms connected at a common fulcrum and having opposed locking hooks for enclosing a post locking aperture formed between said arms, said aperture being configured to receive said post, said swing arms having respective release tabs for grasping by one hand, said release tabs being positioned in opposed spaced relation to one another for opening said post locking aperture upon being pressed toward each other for removing said buckle assembly from said post;

a strap roller for receiving said strap; and a spring-loaded strap release for selectively preventing and permitting movement of said strap around said roller for relative adjustment of said strap and said assembly;

wherein said swing arms each comprises an integral arm spring for configuring said post locking aperture in a normally locked position.

2. The buckle assembly recited in claim 1 further comprising a pair of spring stops positioned relative to said arm springs for limiting the motion of said arm springs upon opening of said post locking aperture.

3. A buckle assembly for securing a strap to a fixed post having an enlarged head; the assembly comprising:

a pair of spring-loaded swing arms connected at a common fulcrum and having opposed locking hooks for enclosing a post locking aperture formed between said arms, said aperture being configured to receive said post, said swing arms having respective release tabs for grasping by one hand, said release tabs being positioned in opposed spaced relation to one another for opening said post locking aperture upon being pressed toward each other for removing said buckle assembly from said post;

a strap roller for receiving said strap; and a spring-loaded strap release for selectively preventing and permitting movement of said strap around said roller for relative adjustment of said strap and said assembly;

wherein said strap release comprises an integral release spring for configuring said strap release in a normally strap-engaging position and a catch for selectively engaging said strap.

4. The buckle assembly recited in claim 3 further comprising a spring stop positioned relative to said release spring for limiting the motion of said release spring upon engagement of said strap release for disengagement of said catch from said strap.

5. A buckle assembly for securing a strap to a fixed post having an enlarged head; the assembly comprising:

a pair of spring-loaded swing arms connected at a common fulcrum and having opposed locking hooks for enclosing a post locking aperture formed between said arms, said aperture being configured to receive said post, said swing arms having respective release tabs for grasping by one hand, said release tabs being positioned in opposed spaced relation to one another for opening said post locking aperture upon being pressed toward each other for removing said buckle assembly from said post;

a strap roller for receiving said strap; and a spring-loaded strap release for selectively preventing and permitting movement of said strap around said roller for relative adjustment of said strap and said assembly;

further comprising an upper case and a lower case for substantially enclosing said swing arms, said lower case having an elongated slot for selective channeling of said buckle assembly onto said post and for selective removal of said buckle assembly from said post.

6. The buckle assembly recited in claim 5 wherein said post locking aperture is shaped to receive said post and to engage said enlarged head in contiguous abutting relation to prevent inadvertent removal of said buckle assembly from said post.

7. The buckle assembly recited in claim 5 wherein said common fulcrum comprises a fastener for securing said swing arms to each other for relative angular movement therebetween.

8. A buckle assembly for securing a strap to a fixed post having an enlarged head; the assembly comprising:

a pair of spring-loaded swing arms connected at a common fulcrum and having opposed locking hooks for enclosing a post locking aperture formed between said arms, said aperture being configured to receive said post, said swing arms having respective release tabs for grasping by one hand, said release tabs being positioned in opposed spaced relation to one another for opening said post locking aperture upon being pressed toward each other for removing said buckle assembly from said post;

a strap roller for receiving said strap; and a spring-loaded strap release for selectively preventing and permitting movement of said strap around said roller for relative adjustment of said strap and said assembly;

wherein said strap release comprises a bearing engaging a recess in said assembly for permitting limited angular motion toward and away from said strap.

9. The buckle assembly recited in claim 3 wherein said strap release catch is configured for selectively engaging teeth integral to and extending from said strap.

* * * * *